United States Patent [19]

Linwu

[11] Patent Number: 4,930,186

[45] Date of Patent: Jun. 5, 1990

[54] SUITCASE PIVOTING ARM

[76] Inventor: Shwu-Guei Linwu, No. 28, Ta Ma Road, Chung San Tsun, Wai Pu Hsiang, Taichung Hsien, Taiwan

[21] Appl. No.: 306,756

[22] Filed: Feb. 6, 1989

[51] Int. Cl.[5] ..... E05D 11/10

[52] U.S. Cl. ..... 16/325; 16/319; 16/297; 16/341; 297/356; 297/379; 190/100; 190/114

[58] Field of Search ..... 16/292, 319, 321, 325, 16/326, 297, 304, 307, 333, 334, 341, 342, 343, 344; 296/56; 297/356, 379; 150/120; 190/114, 124, 100

[56] References Cited

U.S. PATENT DOCUMENTS 2,966,697 1/1961 Mintz ..... 16/325
4,576,411 3/1986 Kitamura ..... 297/356

FOREIGN PATENT DOCUMENTS 0976404 11/1964 United Kingdom ..... 16/333

*Primary Examiner*—Nicholas P. Godici
*Assistant Examiner*—James Miner

[57] ABSTRACT

A suitcase pivoting arm including an upper and a lower arm member, an actuating plate, a mating block, axle pins, and a spring. The upper and lower arm members are pivotally connected with the actuating plate to allow the actuating plate to freely rotate. The upper arm member includes a round plate shaped front end with inner and outer lugs and one or more notches made therearound, the mating block being pivotally connected to the lower arm member with the top end of the mating block being forced by the spring to be in contact with the periphery of the round plate shaped front end of the upper arm member. Upon turning the arms outward the mating block is allowed to set in the notch of the round plate shaped front end of the upper arm member, the upper arm member is protected from reverse rotation so as to support the lifted suitcase cover. Upon further outward extension of the arms the outer lug of the round plate shaped front end of the upper arm member drives the actuating plate to push the mating block away from the notch so as to allow the upper and lower arm members to pivot freely to allow closing the suitcase. Upon closing the suitcase, the inner lug of the round plate shaped front end of the upper arm member drives the actuating plate to break away from the mating block to reset the pivoting arm.

6 Claims, 3 Drawing Sheets

(D)

(C)

(B)

SUITCASE PIVOTING ARM

BACKGROUND OF THE INVENTION

1. Field of the Invention

This invention is related to a suitcase pivoting arm and, more particularly to a pivoting arm for a suitcase to let the suitcase be lifted and positioned at a predetermined angle. When the cover of the suitcase is continuously expanded over the predetermined angle, the pivoting arm will drive the cover of the suitcase to close.

2. Description of Related Art

Conventional suitcases, as shown in FIG. 3, include a casing 1 and a cover 2. In order to support the cover 2 after lifting the suitcase, a pivoting arm is provided to connect the cover 2 with the casing 1. The pivoting arm used in conventional suitcases is substantially comprised of an upper arm member 3 and a lower arm member 4 pivotally connected by an axle pin 5. There are provided concave and convex portions 501 and 502 between the upper and the lower arm members 3 and 4 to provide frictional resistance while the upper and lower arm members 3 and 4 are pivoting against each other, so as to support the cover 2 and prevent the cover from dropping for easily picking up documents or articles from the casing 1 after it is lifted to a certain level.

In the above-described conventional art, the cover is supported by the frictional resistance between the upper and lower arm members. After a certain period of applied resistance, the frictional resistance will be reduced due to wear and tear of the opposing surfaces of the upper and lower arm members, and therefore, the supporting force of the arm members will deteriorate and become insufficient to support the cover. This problem is commonly encountered by suitcase users.

Because the frictional resistance between the upper and lower arm members is constantly provided during a pivoting motion, excessive effort is required to overcome the constant frictional resistance when opening or closing the suitcase. Further, the cover 1 and the casing 2 normally include an inner lining made of plywood. When opening or closing the cover 2, in order to overcome the frictional resistance of the pivoting arm, connecting portions of the two ends 7, 8 of the pivoting arm with the cover, and the casing shall have to bear relative forces applied thereto. Therefore, the pivotally connecting portions of the cover and the casing with the pivoting arm are easy to damage or tear.

Because the cover is supported by the pivoting arm by resistance due to friction if additional or heavy articles are placed in the inner compartment of the cover, the weight of which surpasses the frictional resistance, the pivoting arm will fail to support the cover. It may be suggested to increase the setting value of the frictional resistance for the pivoting arm. However, if the setting value of the frictional resistance for the pivoting arm is excessively high, the connecting portions of the pivoting arm with the cover and the casing are more easily damaged and an increased force must be applied to close or open the suitcase.

SUMMARY OF THE INVENTION

The main object of the present invention is to provide a pivoting arm for a suitcase to allow the cover of the suitcase to be accurately and firmly positioned at a predetermined angle, to provide easy opening and closing of the cover and a durable structure free from interference when a heavy load is placed in the compartments of the cover.

According to the present invention, a suitcase pivoting arm including an upper arm member, a lower arm member, an actuating plate, a mating block, axle pins, and a spring is provided. This suitcase pivoting arm is characterized in that the upper and lower arm members are pivotally connected with the actuating plate at one end by an axle pin to allow the actuating plate to freely rotate around the axle pin. The upper arm member includes a round plate shaped front end with an inner lug, an outer lug and one or more notches made therearound. The mating block is pivotally connected to the lower arm member with the top end of the mating block being forced by the spring into contact with the periphery of the round plate shaped front end of the upper arm member. When the upper and lower arm members are relatively turned to extend outward to let the mating block be set in the notch of the round plate shaped front end of the upper arm member, the upper arm member is protected from reverse rotation so as to support the lifted suitcase cover. When the upper and lower arm members are continuously extended outward at a predetermined angle, the outer lug of the round plate shaped front end of the upper arm member will drive the actuating plate to push the mating block away from the notch so as to allow the upper and lower arm members to pivot relatively and to allow the suitcase cover to be closed. When the suitcase cover is closing downward, the inner lug of the round plate shaped front end of the upper arm member will drive the actuating plate to break away from the mating block to let the mating block return to an original position in contact with the periphery of the round plate shaped front end of the upper arm member at a predetermined position so as to allow the pivoting arm to be ready for next operation to support the suitcase cover.

Another feature of the present invention is that the suitcase pivoting arm includes a lower arm member having a forked front end with two frame plates for receiving one end of the upper arm member of the pivoting arm for providing a more stable pivotal connection between the upper and lower arm members.

Another feature of the present invention is that the upper arm member of the suitcase pivoting arm includes a hollow axle, wherein the length of the hollow axle extending from the bottom surface is longer than the thickness of the actuating plate, so as to allow the actuating plate to be revolvably mounted on the hollow axle.

Another feature of the suitcase pivoting arm of the present invention is that the inner lug and outer lug at the periphery of the round plate shaped front end of the upper arm member are both formed by a surface wall which is arranged in a predefined length to surround the round plate shaped front end of the upper arm member, such that both ends of the surface wall are alternatively driven to rotate the actuating plate.

A still further feature of the present invention is that the suitcase pivoting arm includes a mating plate including a hollow axle for mounting a spring thereon, the spring being concentrically connected to the lower arm member of the pivoting arm.

The above objects features and advantages of the present invention will be fully understood from the following detailed description considered in connection with the accompanying drawings.

DETAILED DESCRIPTION OF THE PREFERRED EMBODIMENT

Figure 1:
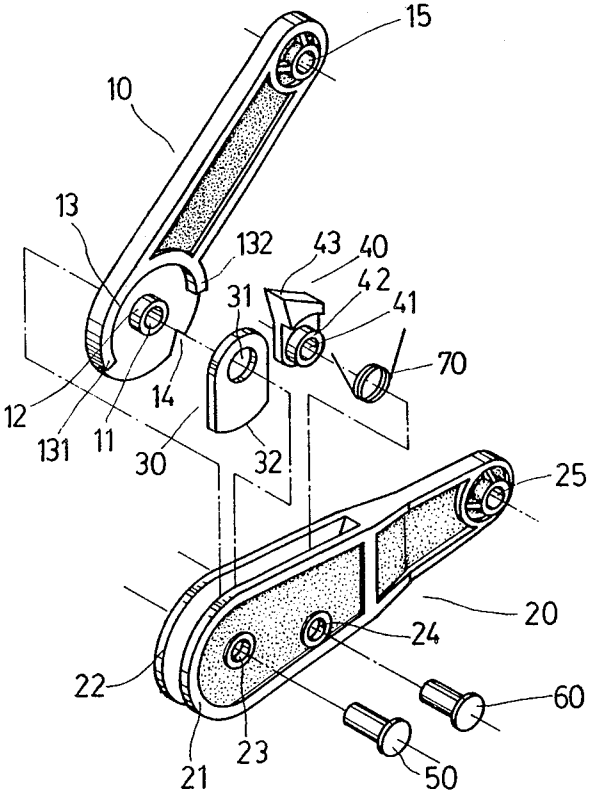
FIG. 1 is a fragmentary perspective view of the present invention.
Figure 2:
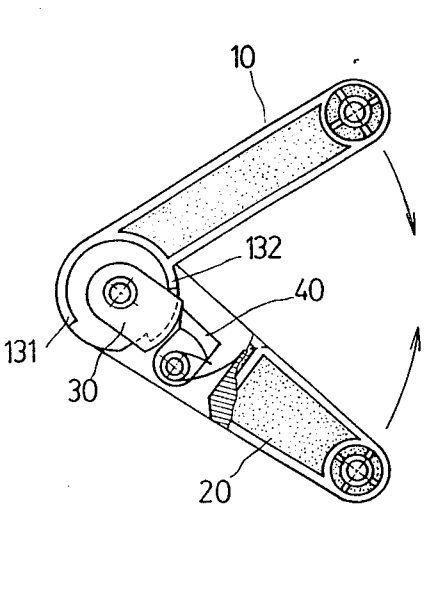
Figure 2:
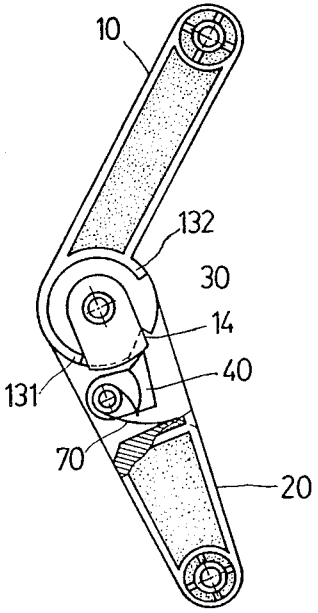
Figure 2:
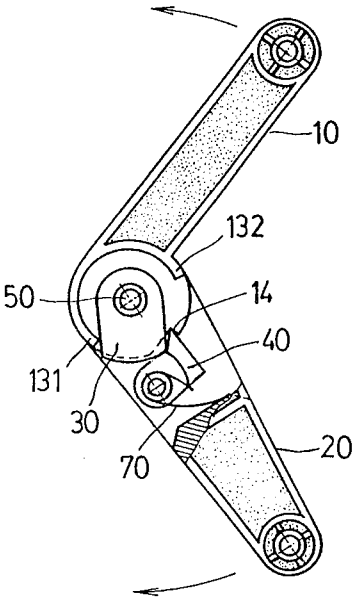
Figure 3:
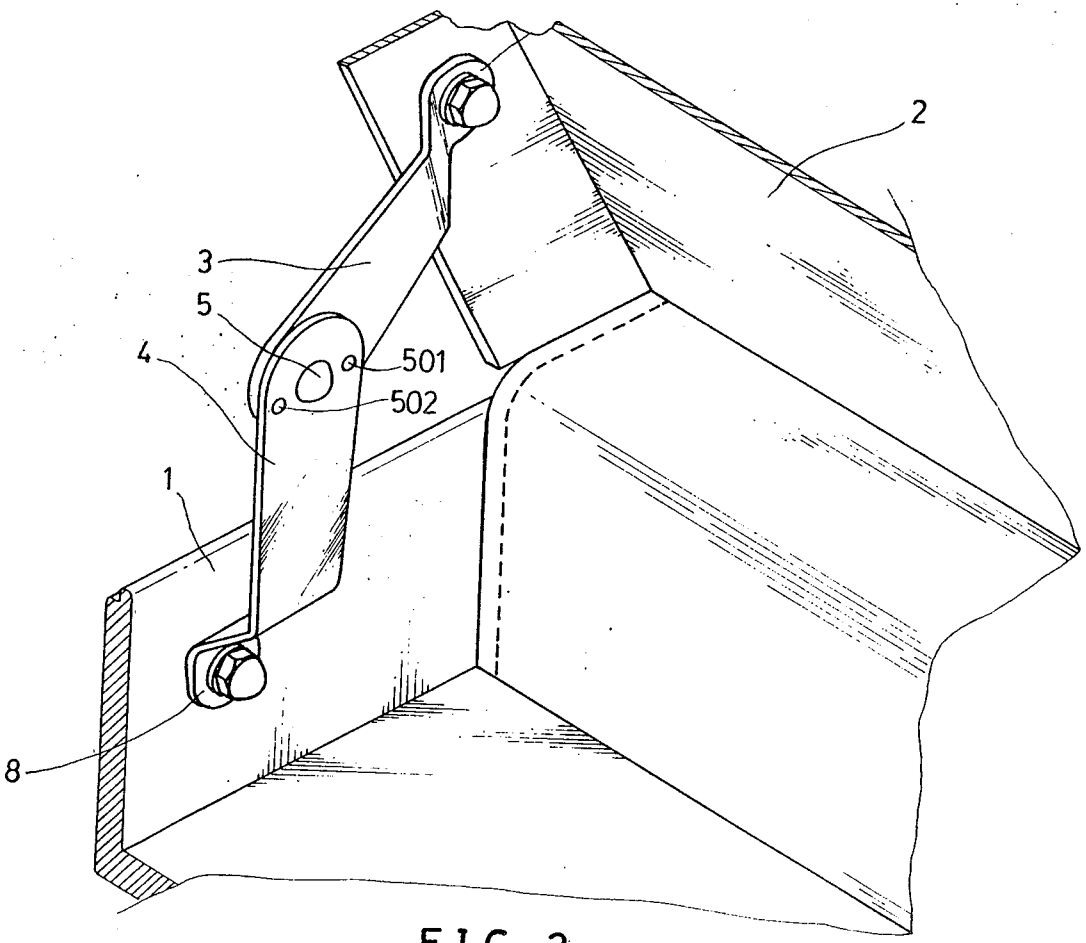
FIG. 3 is a schematic drawing of the prior art.

Referring to FIG. 1, a pivoting arm for a suitcase according to a preferred embodiment of the present invention includes an upper arm member 10, a lower arm member 20, an actuating plate 30, a mating block 40, axle pins 50, 60, and a spring 70.

The upper arm member 10 includes a round plate shaped front end having an axle opening 11 formed at the center thereof to define a hollow axle member 12 therearound, wherein the round plate shaped front end, which includes at least one notch 14, is surrounded with a wall surface 13 of a predetermined length. The wall surface 13 includes two lugs respectively formed with two ends 131 and 132. The upper arm member 10 also includes an axle opening on its rear end pivotally connected to a suitcase cover.

The lower arm member 20 includes a forked front end having two frame plates 21 and 22. The lower arm member 20 may also be arranged to provide a single front frame having two axle openings 23 and 24 respectively formed in both frame plates 21 and 22. There is another axle opening 25 formed in the rear end of the lower arm member 20 pivotally connected to a suitcase cover.

The actuating plate 30 includes an axle opening 31 for revolvably receiving therein the hollow axle member 12 of the upper arm member 10. The actuating plate 30 further includes a curved actuating edge 32, wherein the range between the actuating edge 32 and the axle opening 31 is slightly larger than the radius of the round plate shaped front end of the upper arm member 10. The upper and lower arm members 10, 20 and the actuating plate 30 are pivotally connected together by the insertion of an axle pin 50 into the axle opening 23 of the lower arm member 20 and the axle opening 11 of the upper arm member 10.

The mating block 40 includes a hollow axle member 42 having an axle opening 41 formed therein and a spring member 70 is mounted on the hollow axle member 42. The mating block 40 is pivotally set between the two frame plates 21, 22, with the spring 70 member mounted thereon by insertion of an axle pin 60 through the axle opening 41 of the mating block 40. A top end 43 of the mating block 40 has a thickness approximately equal to the thickness of the round plate shaped front end of the upper arm member 10 plus the thickness of the actuating plate 30. By the arrangement of the spring member 70, the top end 43 of the mating block 40 remains in contact with the periphery of the round plate shaped front end of the upper arm member 10.

Figure 2:
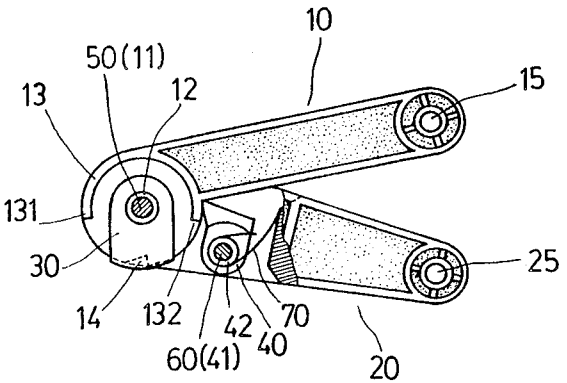
FIGS. 2(A), 2(B), 2(C) and 2(D) are schematic drawings of a preferred embodiment constructed according to the present invention.

The pivoting arm assembled with the above-described component parts is actuated, as shown in FIG. 2, according to the following process:

Before operation, when the suitcase cover and suitcase casing are closed, the relative position of the component parts is as shown in FIG. 2(A). The axle openings 15 and 25 of the upper and lower arm members 10 and 20, respectively are pivoted to one side surface of the suitcase cover and the suitcase casing respectively, allowing the upper and lower arm members 10 and 20 to be retained by the axle pin 50 thereby defining a suitable range for the included angle. Due to the effect of gravity, the actuating plate 30 is downwardly positioned between the two lugs 131 and 132 of the wall surface 13 of the upper arm member 10. The mating block 40 is forced by the spring member 70 into constant contact with the periphery of the round plate shaped front end of the upper arm member 10.

When the suitcase cover is lifted, the upper arm member 10 is displaced upward to pivot the upper and lower arm members relatively outward about the axle pin 50 so as to expand the included angle of the upper arm member 10 and the lower arm member 20. At this moment, the mating block 40 is made to slide along the periphery of the round plate shaped front end of the upper arm member 10. As soon as the lug 131 contacts the actuating plate 30, the actuating plate 30 is driven to rotate concommitantly.

When the included angle between the upper and lower arm members 10 and 20 is extended to a range at which the notch 14 of the upper arm 10 is in alignment with the mating block 40, as shown in FIG. 2(B), the mating block 40 will be set in the notch 14 to prohibit the upper arm member 10 from reverse rotation. That is, the suitcase cover is firmly supported by the pivoting arm and is prohibited from dropping down to enclose the suitcase casing.

In order to release the supporting action of the pivoting arm, the suitcase cover is lifted slightly higher to let the upper and lower arm members 10 and 20 pivot about the axle pin 50 thereby extending the included angle, as shown in FIG. 2(C), so as to further allow the lug 131 to rotatingly drive the actuating plate 30 counter clockwise and push the mating block 40 away from the notch 14. Thereafter, the upper arm member 10 breaks away from the constraint of the mating block 40 and becomes freely rotatable. Because the actuating plate 30 and the mating block 40 are maintained immovable by the effect of the spring member 70, the notch 14 follows the upper arm member 10 to rotate clock-wise to further pass through the mating block 40 such that the suitcase cover is driven by the upper arm member 10 to close the suitcase casing.

When the upper and lower arm members 10 and 20 pivot to a closed position, the notch 14 of the upper arm member 10 passes through the mating block 40 and the inner lug 132 will be in contact with the actuating plate 30, as shown in FIG. 2(D). In order to continuously close the upper and lower arm members 10 and 20 inward, the lug 132 will be forced to drive the actuating plate 30 to rotate clockwise, thereby breaking away from the mating block 40, so as to allow the mating block 40 to resume contact with the periphery of the round plate shaped front end of the upper arm member 10. Thereafter, the pivoting arm is ready for a subsequent lifting of the suitcase cover.

In order to better understand the present invention, the two arm members of the pivoting arm are designated as the upper arm member and the lower arm member, respectively. Actually, while in assembly, both the upper and the lower arm members may be turned upside-down for fixation. In the above embodiment, one or more notches 14 may be made on the upper arm member 10 to selectively position the suitcase cover at one or more positions. Further, in this embodiment, the hollow axle 12 and the wall surface 13 of the upper arm member 10 may be made on the back side of the round plate shaped front end to provide the same effect.

In general, the present invention provides a pivoting arm for suitcase, which has the following numerous advantages:

(A) Because no frictional resistance is required between the upper and lower arm members, the lifting or closing of the suitcase cover is easy and labor saving;

(B) The positioning of the suitcase cover is accurately set and free from the interference of a heavy load in the inner compartment of the suitcase cover; and (C) The pivotally connected portions of the suitcase with the pivoting arm are better protected against loosening or damage. Therefore, the service life of the suitcase can be extended.

I claim:

1. A suitcase pivoting arm comprising:

an upper arm member;

a lower arm member;

an actuating plate;

a mating block;

axle pins; and a spring;

said upper and lower arm members being pivotally connected with said actuating plate at first ends thereof by an axle pin wherein said actuating plate freely rotates around the axle pin;

said upper arm member including a round plate shaped front end with an inner lug, an outer lug and one or more notches formed therearound, said mating block being pivotally connected to said lower arm member and the top end of said mating block being forced by said spring into contact with the periphery of said round plate shaped front end of said upper arm member;

whereby upon rotation of said upper and lower arm members in an outward direction, said mating block is set in said notch of said round plate shaped front end of said upper arm member and said upper arm member is protected from reverse rotation so as to support the lifted suitcase cover;

said upper and lower arm members being continuously extendable outward to a predetermined angle, wherein said outer lug of said round plate shaped front end of said upper arm member drives said actuating plate to push said mating block away from said notch so as to enable said upper and lower arm members to pivot with respect to each other and to allow the suitcase cover to be closed; and at the time the suitcase is closed to within a predetermined angle, said inner lug of said round plate shaped front end of said upper arm member drives said actuating plate to break away from said mating block, thereby enabling said mating block to return to an original position in contact with the periphery of said round plate shaped front end of said upper arm member, the pivoting arm thus being ready for a subsequent operation to support the lifted suitcase cover.

2. A suitcase pivoting arm according to claim 1, wherein a thickness of the top end of said mating block is wider than the thickness of said round plate shaped front end of said upper arm member.

3. A suitcase pivoting arm according to claim 1, wherein said lower arm member includes a forked front end having two frame plates for receiving one end of said upper arm member for providing a stable pivotal connection of said upper and lower arm members.

4. A suitcase pivoting arm according to claim 1, wherein said round plate shaped front end of said upper arm member includes an axle opening, the length of said axle opening raised from the surface of said round plate shaped front end being longer than the thickness of said actuating plate so as to revolvably mount said actuating plate around said axle opening.

5. A suitcase pivoting arm according to claim 1, wherein said inner lug and outer lug at the periphery of said round plate shaped front end of said upper arm member both are formed by a surface wall arranged in a predetermined length to surround said round plate shaped front end, whereby both ends of said surface wall are alternately driven to force said actuating plate to rotate.

6. a suitcase pivoting arm according to claim 1, wherein said mating plate includes an axle opening and wherein said spring is mounted therearound to concentrically connect said spring to said lower arm member.

* * * * *